US005905937A

United States Patent [19]

Plucknett et al.

[11] Patent Number: 5,905,937

[45] Date of Patent: May 18, 1999

[54] METHOD OF MAKING SINTERED DUCTILE INTERMETALLIC-BONDED CERAMIC COMPOSITES

[75] Inventors: Kevin Plucknett, Sharnbrook, United Kingdom; Terry N. Tiegs, Lenoir City; Paul F. Becher, Oak Ridge, both of Tenn.

[73] Assignee: Lockheed Martin Energy Research Corporation, Oak Ridge, Tenn.

[21] Appl. No.: 09/003,374

[22] Filed: Jan. 6, 1998

[51] Int. Cl.[6] ..... B22F 3/10

[52] U.S. Cl. ..... 419/12; 419/13; 419/14; 419/54; 419/57

[58] Field of Search ..... 419/12, 13, 14; 75/236, 249, 6, 54, 57

[56] References Cited

U.S. PATENT DOCUMENTS

| | | | |
|---|---|---|---|
| 4,668,470 | 5/1987 | Gilman et al. | 419/32 |
| 4,762,558 | 8/1988 | German et al. | 75/246 |
| 4,916,029 | 4/1990 | Nagle et al. | 428/614 |
| 4,919,718 | 4/1990 | Tiegs et al. | 75/232 |
| 5,032,353 | 7/1991 | Smarsly et al. | 419/12 |
| 5,098,469 | 3/1992 | Rezhets | 75/249 |
| 5,271,758 | 12/1993 | Buljan et al. | 75/232 |

OTHER PUBLICATIONS

Mei, et al, "Investigation of $Ni_3Al$–Matrix Composites Strengthened by TiC", *J. Mater. Res.*, vol. 8, No. 11, Mater. res, Soc. (1993).

*Primary Examiner*—Ngoclan Mai
*Attorney, Agent, or Firm*—Joseph A. Marasco

[57] ABSTRACT

A method of making an intermetallic-bonded ceramic composite involves combining a particulate brittle intermetallic precursor with a particulate reactant metal and a particulate ceramic to form a mixture and heating the mixture in a non-oxidizing atmosphere at a sufficient temperature and for a sufficient time to react the brittle intermetallic precursor and the reactant metal to form a ductile intermetallic and sinter the mixture to form a ductile intermetallic-bonded ceramic composite.

17 Claims, 1 Drawing Sheet

METHOD OF MAKING SINTERED DUCTILE INTERMETALLIC-BONDED CERAMIC COMPOSITES

The United States Government has rights in this invention pursuant to contract no. DE-AC05-96OR22464 between the United States Department of Energy and Lockheed Martin Energy Research Corporation.

FIELD OF THE INVENTION

The present invention relates to intermetallic-bonded ceramic composites and methods of making the same, and more particularly to those compositions wherein NiAl and Ni are included as starting materials in a method of making $Ni_3Al$/ceramic composites.

BACKGROUND OF THE INVENTION

Conventional methods of making ductile intermetallic-bonded ceramic composites involve hot-pressing of powder mixtures in graphite dies. Complex shaped articles cannot generally be made via such methods because of the axial nature thereof.

For such materials to become viable commercial products, development of sintering techniques not involving the application of mechanical pressure was required. A method was developed to sinter these types of composites to densities to about 90% theoretical density (T.D.) without the application of mechanical pressure.

Attempts to sinter intermetallic-bonded ceramic composites utilizing the same types of powders used for the hot-pressing of these materials were unsuccessful. The relative particle size of the $Ni_3Al$ powders was significantly larger than the ceramic powders. In addition, the $Ni_3Al$ powders employed were pre-alloyed with boron and were characterized by ductility and high strength. Normally, powder mixtures are dispersed by milling together, however, because of the large size difference and the inherent ductility of the $Ni_3Al$ powders, milling was not sufficiently effective in producing a homogeneous mixture. The poor densification (<90% T. D.) is attributed to the insubstantial wetting behavior between the large $Ni_3Al$ particles and the smaller WC and TiC. In addition, the sintered composites revealed large pores believed to be due to the void left by the original $Ni_3Al$ particle after it was 'wicked' into the surrounding carbide particles.

For further information, please refer to the following:

1. U.S. Pat. No. 4,762,558 issued to German, et al. teaches the use of elemental Ni and Al powders in a reaction sintering method of making $Ni_3Al$ at low temperatures (<1000° C.). No additions of ceramic powders are used; $Ni_3Al$ content is 100%.

2. U.S. Pat. No. 4,919,718 issued to Tiegs, et al. teaches the use of large-particle-size (>20 $\mu$m) pre-alloyed ductile $Ni_3Al$ powders to make composites that are densified by hot-pressing. The content of $Ni_3Al$ ranges from 5–20 wt. %.

3. U.S. Pat. No. 5,271,758 issued to Buljan, et al. teaches the use of elemental Ni and Al powders with $Al_2O_3$—TiC mixtures that are densified by hot-pressing. The content of $Ni_3Al$ ranges from 5–20 wt. %.

4. Mei, et al, "Investigation of $Ni_3Al$-Matrix Composites Strengthened by TiC", *J. Mater. Res.*, Vol. 8, No. 11, Mater. res, Soc. (1993) teaches the use of an in-situ reaction of Ni, Al, C and Ti powders to produce materials with 35 wt. % (45 vol. %) TiC in a $Ni_3Al$ matrix (55 vol. %).

OBJECTS OF THE INVENTION

Accordingly, it is an object of the present invention to provide

It is another object of the present invention to provide

Further and other objects of the present invention will become apparent from the description contained herein.

SUMMARY OF THE INVENTION

In accordance with one aspect of the present invention, the foregoing and other objects are achieved by a method of making an intermetallic-bonded ceramic composite including the steps of:

a. combining a particulate brittle intermetallic precursor with a particulate reactant metal and a particulate ceramic to form a mixture; and b. heating the mixture in a non-oxidizing atmosphere at a sufficient temperature and for a sufficient time to:
   (1) react the brittle intermetallic precursor and the reactant metal to form a ductile intermetallic; and
   (2) sinter the mixture to form a ductile intermetallic-bonded ceramic composite.

In accordance with another aspect of the present invention, a method of making a $Ni_3Al$-bonded ceramic composite includes the steps of:

a. combining particulate NiAl with particulate Ni and a particulate ceramic to form a mixture; and b. heating the mixture in a non-oxidizing atmosphere at a sufficient temperature and for a sufficient time to:
   1. react the NiAl and the Ni to form $Ni_3Al$; and
   2. sinter the mixture to form a $Ni_3Al$-bonded ceramic composite.

In accordance with a further aspect of the present invention, an intermetallic-bonded ceramic composite comprising a body of ceramic material sintered with a intermetallic having a ductility of at least 10% elongation, said body having a density of at least 90% theoretical density.

For a better understanding of the present invention, together with other and further objects, advantages and capabilities thereof, reference is made to the following disclosure and appended claims in connection with the above-described drawings.

DETAILED DESCRIPTION OF THE INVENTION

A major problem associated with the use of a pre-alloyed $Ni_3Al$ powder is the inherent ductility and high strength thereof. Upon subjection to conventional milling processes, $Ni_3Al$ particles do not reduce in size as intended, but rather tended to flatten.

In contrast to $Ni_3Al$, other nickel aluminide intermetallics such as NiAl, $NiAl_3$, $Ni_2Al_3$, and $Ni_5Al_3$ are inherently brittle and the particle size thereof can be reduced by conventional milling processes.

In accordance with the present invention, a brittle nickel aluminide is reduced to small-particle-size and used as a precursor along with a sufficient amount of fine Ni powders and optionally other alloying additives, for example, B, Fe, Cr, Zr, Ti, W, Hf, Mo, to produce a final composition of ductile $Ni_3Al$ via the reaction:

$$NiAl(s)+2Ni(s)>Ni_3Al(s)$$

These method steps overcome the problems described hereinabove relating to the use of large-particle-size pre-alloyed ductile, $Ni_3Al$ powders. The optional additives are generally those typically used in ductile $Ni_3Al$ materials.

The present invention thus involves the use of a brittle intermetallic precursor that can be reduced in size (<20 μm, preferably <10 μm) to produce a homogeneous mixture with fine (<20 μm, preferably <10 μm) ceramic powders and a reactant which converts the brittle intermetallic precursor to a ductile intermetallic. Moreover, the homogeneous mixture can be sintered to densities of at lease 90% T.D. without the application of mechanical pressure. The volume content of $Ni_3Al$ generally ranges from 5 to 50 vol. %.

The present invention includes the use of other aluminide systems such as, for example, FeAl, $FeAl_2$, $Fe_2Al_5$, $FeAl_3$, TiAl, $TiAl_2$, $TiAl_3$, and $Ti_3Al$. Moreover, the present invention includes the use of other aluminide bondable ceramic systems such as, for example, TiN, Ti(C,N), VC, $Mo_2C$, TaC, ZrC, HfC, $TiB_2$, $ZrB_2$, $HfB_2$, chromium carbides, etc. The benefits of the present invention are best realized where brittleness of the intermetallic precursor is no more than 5% elongation, and the ductility of the intermetallic product is at least 10% elongation.

Figure 1:
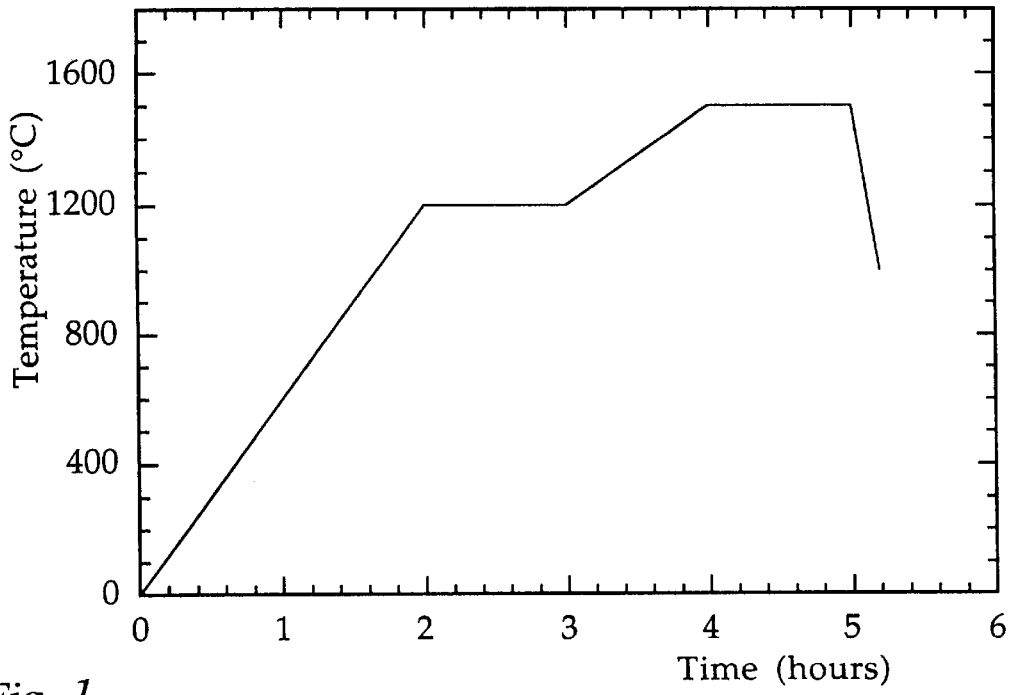
FIG. 1 is a graph showing a typical sintering schedule used in methods of making intermetallic-bonded ceramic composites in accordance with the present invention.

EXAMPLE I 59.16 g TiC powder (1.3 μm average particle size) and a stoichiometric amount (9.378) of NiAl powder (−325 mesh, <44 μm) were ball milled in iso-propyl alcohol for 20 hours using $ZrO_2$ milling media (Y-TZP). 12.851 g of a fine Ni powder (<10 μm) was added (an amount sufficient to form $Ni_3Al$ via reaction with the NiAl component in a subsequent reaction step), and the resulting mixture was ball milled for a further 4 hours. After milling the mixture was dried and sieved to −200 mesh (<75, um). Samples thereof were compacted into 32 mm diameter discs by uniaxial cold pressing at ~42 MPa. The samples were sintered under vacuum according to the following sintering schedule, illustrated in FIG. 1:

a. a first heating rate of 10° C./min.

b. a first holding time of 60 min. at a first holding temperature of 1200° C.

c. a second heating rate of 5° C./min.

d. a second holding time of 60 min. at a second holding temperature (sintering temperature) 1500° C.

Figure 2:
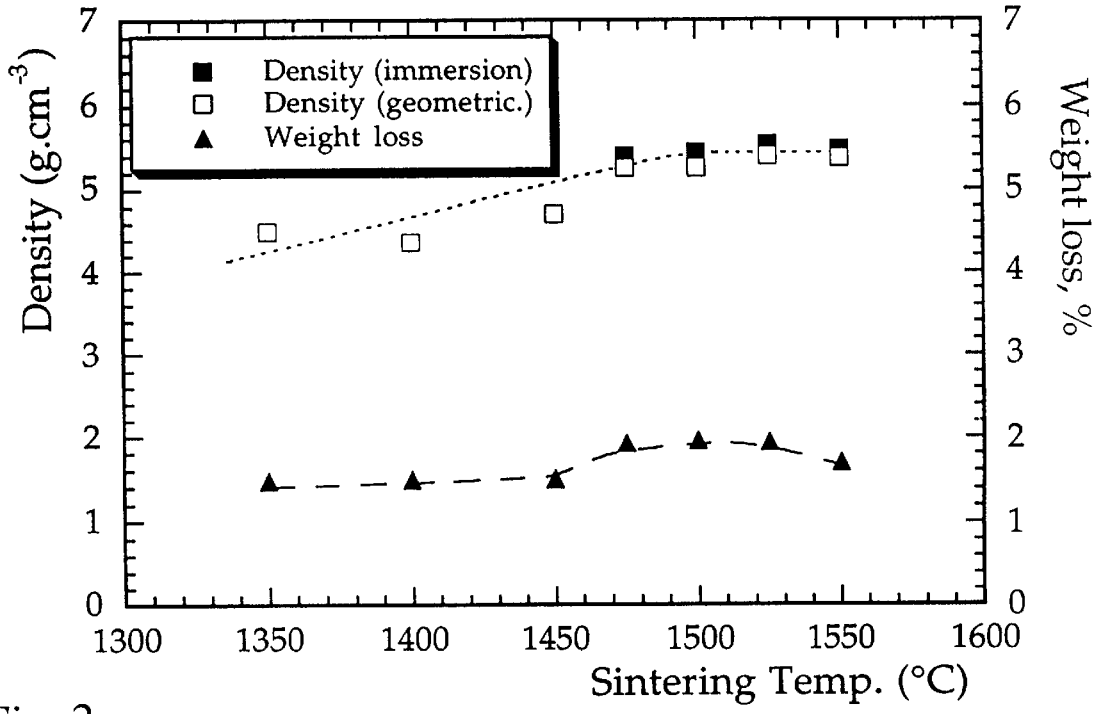
FIG. 2 is a graph showing the effects of sintering temperature upon sintered density of intermetallic-bonded ceramic composites made in accordance with the present invention.

The resultant ductile intermetallic-bonded ceramic composite were characterized at >93% T.D. The effects of sintering temperature upon sintered density is shown in FIG. 2.

The sintering schedule can vary widely, depending on composition of the composite and the size and shape of the article being made. For example, typical sintering schedules suitable for many applications on the present invention are suggested:

a. A first heating rate in the range of about 3° C./min. to about 25° C./min.

b. A first holding time in the range of about 30 min. to about 90 min. at a first holding temperature in the range of about 800° C. to about 1300° C.

c. A second heating rate in the range of about 3° C./min. to about 10° C./min.

d. A second holding time in the range of about 30 min. to about 90 min. at a second holding temperature in the range of about 900° C. to about 1600° C.

The above described type of sintering schedule is especially suitable for allowing sufficient out-gassing of the sample during heating in order to prevent any internal gas pressure build-up from the formation of CO within the article. CO is a product of a reaction of surface oxide on any of the powder constituents with a carbide constituent.

EXAMPLE II

Various intermetallic-bonded ceramic composites were made. Selected amounts of powder starting materials were ball milled together to form $Ni_3Al$ hardmetal mixtures. The powder physical characteristics of selected starting materials are shown in Table I. All of the compositions were made with 0.1 wt. % boron addition, and some composites were made with alloying additives, such as Fe, W or Ti. The milling was carried out in isopropanol for 16 hours using conventional powder processing techniques. The mixtures were then dried and screened to −100 mesh. Specimens were uniaxially pressed in 25 mm steel dies at ~70 MPa (10 ksi) and iso-pressed at 350 MPa (50 ksi). Sintering was carried out under vacuum in a tungsten element furnace at temperatures of 1550° C. to 1600° C. Compositions with binder contents ranging from 20 to 30 vol. % were made in this fashion. The discs were then heat treated at 1450° C. and 1.7 MPa gas pressure to increase the densities thereof. The compositions and sintered densities after each step are shown in Table 2. As indicated, high densities were achieved for most of the samples.

TABLE I

| Starting Material | Average Particle Diameter (μm) |
|---|---|
| WC | 2.5 |
| TiC | 1.3 |
| Ni | 5 |
| NiAl | 10.9 |
| Fe | 5 |
| W | 1 |
| Ti | 7 |
| B | 0.3 |

TABLE II

| | % Theoretical Density After Sintering | | % Theoretical Density After Heat Treatment | |
|---|---|---|---|---|
| Composition | 1550° C. | 1600° C. | 1550° | 1600° |
| WC-20 vol. % $Ni_3Al$ | 96.8 | 96.9 | 98.6 | 98.3 |
| WC-20 vol. % $Ni_3Al$ + 5% Fe | 96.0 | 98.3 | 98.9 | 99.5 |
| WC-20 vol. % $Ni_3Al$ + 5% W | 96.0 | 97.1 | 98.2 | 98.3 |
| WC-20 vol. % $Ni_3Al$ + 5% Ti | 92.0 | 92.9 | 95.7 | 95.4 |
| WC-5 wt. % TiC-20 vol. % $Ni_3Al$ | 90.0 | 92.1 | 93.0 | 94.4 |
| WC-30 vol. % $Ni_3Al$ | 98.4 | 97.9 | 98.7 | 98.1 |

Intermetallic bonded composites have been shown to have mechanical properties appropriate for structural applications such as cutting tools and wear parts. In addition, they have been shown to have significant improvement in corrosion resistance compared to comparable materials such as WC—Co. Various properties of these materials include: high strength; high toughness; high hardness; high corrosion resistance; electrical conductivity; non-magnetic; strength retention to elevated temperatures (for example, 800° C.) and high reflectivity when polished.

Applications for these types of materials include, but are not limited to: wear parts and pads; cutting tools; forming dies; pump seals; valves, including stems and seats; washers; thread guides; wire drawing dies; can forming dies, especially with synthetic lubricants; plastic drawing dies; thermal spray coatings; sour gas (natural gas with hydrogen sulfide) applications; non-magnetic applications such as guidance gyroscopes, dies for ceramic magnets, and tape player heads; and gage blocks.

While there has been shown and described what are at present considered the preferred embodiments of the present invention, it will be obvious to those skilled in the art that various changes and modifications can be made therein without departing from the scope of the inventions defined by the appended claims.

What is claimed is:

1. A method of making an intermetallic-bonded ceramic composite comprising the steps of:

a. providing a particulate brittle intermetallic precursor comprising at least one of NiAl, $NiAl_3$, $Ni_2Al_3$, or $Ni_5Al_3$;

b. combining said precursor with particulate Ni and a particulate ceramic to form a mixture; and c. heating said mixture in a non-oxidizing atmosphere at a sufficient temperature and for a sufficient time to:

(1) react said precursor and said Ni to form a ductile intermetallic; and (2) sinter said mixture to form a ductile intermetallic-bonded ceramic composite.

2. A method of making an intermetallic-bonded ceramic composite comprising the steps of:

a. providing a particulate brittle intermetallic precursor comprising at least one of FeAl, $FeAl_2$, $Fe_2Al_5$, or $FeAl_3$;

b. combining said precursor with particulate Fe and a particulate ceramic to form a mixture; and c. heating said mixture in a non-oxidizing atmosphere at a sufficient temperature and for a sufficient time to:

(1) react said precursor and said Fe to form a ductile intermetallic; and (2) sinter said mixture to form a ductile intermetallic-bonded ceramic composite.

3. A method of making an intermetallic-bonded ceramic composite comprising the steps of:

a. providing a particulate brittle intermetallic precursor comprising at least one of TiAl, $TiAl_2$, $TiAl_3$, and $Ti_3Al$;

b. combining said precursor with particulate Ti and a particulate ceramic to form a mixture; and c. heating said mixture in a non-oxidizing atmosphere at a sufficient temperature and for a sufficient time to:

(1) react said precursor and said Ti to form a ductile intermetallic; and (2) sinter said mixture to form a ductile intermetallic-bonded ceramic composite.

4. A method in accordance with claim 1 wherein said ceramic comprises at least one of TiC, TiN, Ti(C,N), WC, VC, $Mo_2C$, TaC, ZrC, HfC, $TiB_2$, $ZrB_2$, $HfB_2$, or chromium carbides.

5. A method in accordance with claim 1 wherein said combining step further comprises combining at least one alloying additive with said precursor, said particulate Ni, and said particulate ceramic.

6. A method in accordance with claim 5 wherein said alloying additive comprises at least one of B, Fe, Cr, Zr, Ti, W, Hf, or Mo.

7. A method in accordance with claim 1 wherein said heating step further comprises:

a. A first heating rate in the range of about 3° C./min. to about 25° C./min.

b. A first holding time in the range of about 30 min. to about 90 min. at a first holding temperature in the range of about 800° C. to about 1300° C.

c. A second heating rate in the range of about 3° C./min. to about 10° C./min.

d. A second holding time in the range of about 30 min. to about 90 min. at a second holding temperature in the range of about 900° C. to about 1600° C.

8. A method of making a $Ni_3Al$-bonded ceramic composite comprising the steps of:

a. combining particulate NiAl with particulate Ni and a particulate ceramic to form a mixture; and b. heating said mixture in a non-oxidizing atmosphere at a sufficient temperature and for a sufficient time to:

(1) react said NiAl and said Ni to form $Ni_3Al$; and (2) sinter said mixture to form a $Ni_3Al$-bonded ceramic composite.

9. A method in accordance with claim 8 wherein said heating step comprises:

a. A first heating rate in the range of about 3° C./min. to about 25° C./min.

b. A first holding time in the range of about 30 min. to about 90 min. at a first holding temperature in the range of about 800° C. to about 1300° C.

c. A second heating rate in the range of about 3° C./min. to about 10° C./min.

d. A second holding time in the range of about 30 min. to about 90 min. at a second holding temperature in the range of about 900° C. to about 1600° C.

10. A method in accordance with claim 2 wherein said ceramic comprises at least one of TiC, TiN, Ti(C,N), WC, VC, $Mo_2C$, TaC, ZrC, HfC, $TiB_2$, $ZrB_2$, $HfB_2$, or chromium carbides.

11. A method in accordance with claim 2 wherein said combining step further comprises combining at least one alloying additive with said precursor, said particulate Fe, and said particulate ceramic.

12. A method in accordance with claim 11 wherein said alloying additive comprises at least one of B, Ni, Cr, Zr, Ti, W, Hf or Mo.

13. A method in accordance with claim 2 wherein said heating step further comprises:

a. A first heating rate in the range of about 3° C./min. to about 25° C./min.

b. A first holding time in the range of about 30 min. to about 90 min. at a first holding temperature in the range of about 800° C. to about 1300° C.

c. A second heating rate in the range of about 3° C./min. to about 10° C./min.

d. A second holding time in the range of about 30 min. to about 90 min. at a second holding temperature in the range of about 900° C. to about 1600° C.

14. A method in accordance with claim 3 wherein said ceramic comprises at least one of TiC, TiN, Ti(C,N), WC, VC, $Mo_2C$, TaC, ZrC, HfC, $TiB_2$, $ZrB_2$, $HfB_2$, or chromium carbides.

15. A method in accordance with claim 3 wherein said combining step further comprises combining at least one alloying additive with said precursor, said particulate Ti, and said particulate ceramic.

16. A method in accordance with claim 15 wherein said alloying additive comprises at least one of B, Ni, Cr, Zr, Fe, W, Hf, or Mo.

17. A method in accordance with claim 3 wherein said heating step further comprises:

a. A first heating rate in the range of about 3° C./min. to about 25° C./min.

b. A first holding time in the range of about 30 min. to about 90 min. at a first holding temperature in the range of about 800° C. to about 1300° C.

c. A second heating rate in the range of about 3° C./min. to about 10° C./min.

d. A second holding time in the range of about 30 min. to about 90 min. at a second holding temperature in the range of about 900° C. to about 1600° C.

* * * * *